US009090364B2

(12) United States Patent
Vietz et al.

(10) Patent No.: US 9,090,364 B2
(45) Date of Patent: Jul. 28, 2015

(54) METHOD FOR PACKAGING POLYCRYSTALLINE SILICON

(75) Inventors: Matthias Vietz, Mattighofen (AT); Rainer Hoelzlwimmer, Neuoetting (DE)

(73) Assignee: Wacker Chemie AG, Munich (DE)

( * ) Notice: Subject to any disclaimer, the term of this patent is extended or adjusted under 35 U.S.C. 154(b) by 519 days.

(21) Appl. No.: 13/571,485

(22) Filed: Aug. 10, 2012

(65) Prior Publication Data

US 2013/0042582 A1 Feb. 21, 2013

(30) Foreign Application Priority Data

Aug. 18, 2011 (DE) ..... 10 2011 081 196

(51) Int. Cl.

| | |
|---|---|
| ***B65B 5/10*** | (2006.01) |
| ***B65B 25/00*** | (2006.01) |
| ***B65B 39/00*** | (2006.01) |
| ***B65B 43/58*** | (2006.01) |
| ***B65B 43/59*** | (2006.01) |
| ***B65B 1/06*** | (2006.01) |
| ***B65B 1/32*** | (2006.01) |

(52) U.S. Cl.

CPC . *B65B 5/108* (2013.01); *B65B 1/06* (2013.01); *B65B 1/32* (2013.01); *B65B 25/00* (2013.01); *B65B 39/007* (2013.01); *B65B 43/58* (2013.01); *B65B 43/59* (2013.01)

(58) Field of Classification Search

CPC ..... B65B 43/54; B65B 43/56; B65B 43/58; B65B 43/59; B65B 39/14; B65B 39/00; B65B 39/007

USPC ..... 53/449–451, 502, 545, 550, 551, 170, 53/171, 173, 445, 511, 433, 425, 542; 141/10, 83, 286, 275, 313, 390, 316, 141/318, 369, 370, 374, 263

See application file for complete search history.

(56) References Cited

U.S. PATENT DOCUMENTS

| | | | | |
|---|---|---|---|---|
| 1,653,200 | A * | 12/1927 | Belcher | 141/10 |
| 2,628,907 | A | 2/1953 | Darden | |
| 4,185,669 | A * | 1/1980 | Jevakohoff | 141/59 |
| 4,325,418 | A | 4/1982 | Henle | |
| 5,971,038 | A * | 10/1999 | Fiedler et al. | 141/83 |
| 7,877,966 | B2 * | 2/2011 | Knoke et al. | 53/469 |
| 8,833,042 | B2 * | 9/2014 | Wochner et al. | 53/434 |
| 2001/0025470 | A1 | 10/2001 | Straub | |
| 2004/0182469 | A1 | 9/2004 | Concetti | |
| 2005/0034430 | A1 | 2/2005 | Holzlwimmer et al. | |
| 2006/0011653 | A1 | 1/2006 | Fontaine et al. | |
| 2010/0154357 | A1 | 6/2010 | Wochner et al. | |

FOREIGN PATENT DOCUMENTS

| | | | |
|---|---|---|---|
| CN | 100350226 | C | 11/2007 |
| DE | 2743874 | A1 | 4/1978 |
| DE | 2907015 | A1 | 9/1980 |
| DE | 3221436 | C2 | 12/1984 |
| DE | 3640520 | A1 | 6/1988 |
| DE | 102007027110 | A1 | 12/2008 |
| EP | 1334907 | B1 | 4/2004 |
| FR | 2789050 | A1 | 8/2000 |
| GB | 2121755 | A | 1/1984 |
| JP | 53049597 | A2 | 5/1978 |
| JP | 9328101 | A2 | 12/1997 |
| JP | 2010528955 | T2 | 8/2010 |
| KR | 20100018060 | A | 2/2010 |
| WO | 0044488 | A1 | 8/2000 |

OTHER PUBLICATIONS

Abstract for JP 53049597.
Abstract for JP 9328101.
PatBase abstract for DE 3640520 A1 (1988).
PatBase abstract for DE 2743874.

* cited by examiner

*Primary Examiner* — Timothy L Maust
*Assistant Examiner* — Timothy P Kelly
(74) *Attorney, Agent, or Firm* — Caesar Rivise, PC

(57) ABSTRACT

A method is disclosed for packaging polycrystalline silicon, in which a plastic bag is filled with polycrystalline silicon by means of a filling device, which has a freely suspended energy absorber consisting of a nonmetallic low-contamination material, wherein the plastic bag is pulled over the energy absorber and filled with polycrystalline silicon, and the plastic bag is lowered downward during the filling, so that the silicon slides into the plastic bag. Also disclosed is a method for packaging polycrystalline silicon, in which a plastic bag is filled with polycrystalline silicon by means of a filling device, wherein a storage container has an opening through which it is filled with silicon, the plastic bag being pulled over the storage container after filling the storage container with silicon and the storage container subsequently being rotated so that the silicon slides out of the storage container into the plastic bag.

6 Claims, No Drawings

METHOD FOR PACKAGING POLYCRYSTALLINE SILICON

BACKGROUND OF THE INVENTION

The invention describes a method for packaging polycrystalline silicon.

Polycrystalline silicon (polysilicon) is mainly deposited by means of the Siemens method from halosilanes such as trichlorosilane and subsequently comminuted into polycrystalline silicon chunks with minimal contamination.

For applications in the semiconductor and solar industries, minimally contaminated fragmented polysilicon is desired. For this reason, the material should also be packaged with low contamination before it is transported to the customer.

Conventionally, fragmented polysilicon for the electronics industry is packaged in 5 kg bags with a weight tolerance of +/−max. 50 g. For the solar industry, fragmented polysilicon in bags with a weigh-in of 10 kg and a weight tolerance of +/−max. 100 g is usual.

Tube bag machines, which are suitable in principle for the packaging of fragmented silicon, are commercially available. A corresponding packaging machine is described, for example in DE 36 40 520 A1.

Fragmented polysilicon is a sharp-edged, non-flowable bulk material with a weight of up to 2500 g for the individual Si chunks. During packaging, it is therefore necessary to take care that the material does not pierce, or in the worst case even entirely destroy, the conventional plastic bags when they are being filled.

In order to prevent this, commercially available packaging machines need to be suitably modified for the purpose of packaging polysilicon.

EP 1 334 907 B1 discloses a device for the low-cost fully automatic transportation, weighing, portioning, filling and packaging of high-purity fragmented polysilicon, comprising a feed chute for the fragmented polysilicon, a weighing device for the fragmented polysilicon, which is connected to a funnel, deflection plates made of silicon, a filling device which forms a plastic bag from a high-purity plastic sheet and comprises a deionizer which prevents static charging and therefore particle contamination of the plastic sheet, a welding device for the plastic bag filled with the fragmented polysilicon, a flowbox which is arranged above the feed chute, weighing device, filling device and welding device and prevents particle contamination of the fragmented polysilicon, and a conveyor belt with a magnetically inductive detector for the welded plastic bag filled with fragmented polysilicon, all the components which come in contact with the fragmented polysilicon being sheathed with silicon or clad with a highly wear-resistant plastic.

It has been found that with such devices, the silicon chunks often stick in the filling device. This is disadvantageous since it entails increased stoppage times of the machine.

Piercing of the plastic bag also occurs, which likewise leads to a stoppage time of the system and contamination of the silicon.

DE 10 2007 027 110 A1 discloses a method for packaging polycrystalline silicon, in which a freely suspended ready-formed bag is filled with polycrystalline silicon by means of a filling device, the filled bag subsequently being sealed, characterized in that the bag consists of high-purity plastic with a wall thickness of from 10 to 1000 μm, the filling device comprising a freely suspended energy absorber consisting of a nonmetallic low-contamination material, which is introduced into the plastic bag before filling with the polycrystalline silicon and through which the plastic bag is filled with the polycrystalline silicon, the freely suspended energy absorber is subsequently removed from the plastic bag filled with polycrystalline silicon and the plastic bag is sealed.

By such a method, which provides an energy absorber inside the plastic bag, piercing of the plastic bag can be substantially avoided. A disadvantage with this method, however, is that sticking still occurs. In this method, this primarily occurs in the energy absorber. It therefore continues to lead to production stoppages and requires mechanical interventions, which entail contamination of the silicon.

It is an object of the invention to avoid such sticking of the silicon.

DESCRIPTION OF THE INVENTION

The object is achieved by a method for packaging polycrystalline silicon, in which a plastic bag is filled with polycrystalline silicon by means of a filling device, the filling device comprising a freely suspended energy absorber consisting of a nonmetallic low-contamination material, characterized in that the plastic bag is pulled over the energy absorber and filled with polycrystalline silicon, and the plastic bag is lowered downward during the filling, so that the silicon slides into the plastic bag.

The object is also achieved by a second method for packaging polycrystalline silicon, in which a plastic bag is filled with polycrystalline silicon by means of a filling device, characterized in that a storage container comprises an opening through which it is filled with silicon, the plastic bag being pulled over the storage container after filling the storage container with silicon and the storage container subsequently being rotated so that the silicon slides out of the storage container into the plastic bag.

The object is also achieved by a third method for packaging polycrystalline silicon, in which a plastic bag is filled with polycrystalline silicon by means of a filling device, characterized in that a storage container comprises at least two openings, a plastic bag being pulled over one side of the storage container which comprises one of the at least two openings, the storage container is filled with silicon through the second of the at least two openings, the storage container being arranged at least at the start of the filling process so that the silicon does not initially come in contact with the plastic bag during the filling, but instead the silicon only slides into the plastic bag after the plastic bag is lowered.

It has been found that all three methods prevent the silicon from sticking.

The first method according to the invention likewise uses an energy absorber as already known from the prior art. The actual filling process, however, differs from the procedure described in the prior art. During the filling with silicon, the plastic bag is lowered downward. The presence of the energy absorber furthermore prevents piercing of the plastic bag, since it is protected by the energy absorber against hard impact of the silicon. At the same time, the lowering of the plastic bag ensures that no sticking takes place in the energy absorber.

The second and third methods according to the invention obviate an energy absorber placed in the plastic bag. However, the storage containers used in these cases fulfill a similar function.

In the second method according to the invention, a storage container is first filled with silicon. For this purpose, the storage container comprises at least one opening, through which it is filled with the silicon. After the storage container has been filled, a plastic bag is pulled over the side of the storage container which comprises the opening through which it was filled with the silicon. The storage container together with the plastic bag is subsequently rotated so that the silicon slides out of the storage container into the plastic bag. To this end, the storage container is for example pulled away upward. Here as well, piercing of the plastic bag can be reliably avoided since the fall distance of the silicon in order to reach the plastic bag from the storage container is virtually negligible.

The third method according to the invention adopts a somewhat different approach. Here, the plastic bag is already pulled over the storage container at the start of the filling process. The storage container in this case comprises at least two openings. It is filled with silicon through one opening. Through the second opening, silicon can slide into the plastic bag. The storage container and plastic bag are arranged in such a way, for example inclined, that the silicon with which the storage container is filled can in no case immediately encounter the plastic bag or come in contact with it. The silicon first comes in contact with an inner wall of the storage container. It thereby loses kinetic energy and slides slowly through the second opening into the plastic bag. The storage container is therefore likewise used as a kind of energy absorber.

Preferably, the storage container or the energy absorber comprises a weighing balance.

This weighing balance preferably consists of a hard metal, ceramic or carbides.

The preferably prefabricated bag is pulled over the weighing balance and filled by rotation of the entire unit with little further comminution.

In the first and second methods, the weighing balance is preferably configured as a screen and is located at the bottom of the energy absorber or the storage container.

Preferably, a shaking mechanism is provided in order to be able to fully prevent sticking and in order to achieve better separation.

Such a shaking mechanism may, for example, be generated by ultrasound.

Another preferred embodiment provides a weighing balance with transfer to an energy absorber.

In this case, the plastic bag is pulled over the energy absorber, the weighing balance including the screen is subsequently opened, a fall brake is subsequently opened and closed and the bag is subsequently lowered with a wave-like movement and/or shaking.

As the fall brake, it is preferable to use a device which is pressed against the plastic bag or energy absorber.

In this way, the cross section of the plastic bag, or of the energy absorber, is first reduced and then released in a controlled way.

The product flow can therefore be controlled and filling of the prefabricated bag with the silicon can be achieved with little further comminution.

Preferably, in the first method, the energy absorber consists of a nonmetallic low-contamination material.

Unlike in the case of DE 10 2007 027 110, the energy absorber is not inserted into the plastic bag before it is filled with the polycrystalline silicon, but instead the plastic bag is pulled over the energy absorber.

Preferably, the plastic bag is pulled over the energy absorber by means of a suitable handling system. For example, a buckling arm robot is suitable for this.

According to the first method, the plastic bag is filled with the polycrystalline silicon by means of the energy absorber.

During the filling, the plastic bag is moved downward.

This is preferably done by means of suitable gripper systems.

In all three methods, the plastic bag is preferably sealed after the filling process.

The plastic bag is preferably first evacuated by sucking air out of the plastic bag, and then welded.

For easier handling, a grip hole may in this case be stamped into the plastic bag, and any excess of the bag may be removed after the welding.

In contrast to the fixed position of the freely suspended prefabricated bag, with the first method according to the present invention a filling process free of sticking, with little further comminution and little piercing is possible by means of the flexible positioning of the bag gripper.

The described methods are suitable both for the packaging of fragmented polysilicon for solar applications and for fragmented polysilicon for the electronics industry. In particular, this method is suitable for the packaging of sharp-edged polycrystalline silicon chunks weighing up to 10 kg. The advantages are particularly significant in the presence of chunks having an average weight of more than 80 g.

The plastic bag preferably consists of a high-purity plastic. It preferably consists of polyethylene (PE), polyethylene terephthalate (PET) or polypropylene (PP) or composite sheet.

A composite sheet is a multilayer packaging sheet, from which flexible packaging is made. The individual sheet layers are conventionally extruded or laminated. The packaging is primarily employed in the food industry.

Preferably, the plastic bag is held by means of at least two elements on the bag and moved downward away from the energy absorber during the filling with fragmented polysilicon, and delivered to a sealing device, preferably a welding device, by means of these grippers after the end of the filling process.

The plastic bag preferably has a thickness of from 10 to 1000 μm.

The energy absorber preferably consists of a nonmetallic low-contamination material. It preferably has the shape of a funnel or hollow body.

It preferably consists of textile material (for example Gore-Tex® PTFE fabric or polyester/polyamide fabric) or plastics (for example PE, PP, PA or copolymers of these plastics). It particularly preferably consists of a rubber-elastic plastic, for example PU, latex rubber or ethylene vinyl acetate (EVA), with a Shore A hardness of between 30 A and 120 A, preferably 70 A.

The sealing of the plastic bag may for example be carried out by means of welding, adhesive bonding, a seam or a form fit. It is preferably carried out by means of welding.

The filling device preferably consists of a filling unit and the freely suspended energy absorber, or the storage container, which is connected to the filling unit. The freely suspended energy absorber preferably has the form of a freely suspended mobile flexible tube or one of the other forms mentioned, which are also to be understood under the term tube in what follows for the sake of simplicity.

The plastic bag is drawn over the mobile flexible tube and the fragmented poly is introduced into the bag by means of the filling unit and the flexible tube.

The filling unit is preferably a funnel, a feed chute or a slide, which are clad with a low-contamination material or consist of a low-contamination material.

The freely suspended energy absorber absorbs a large part of the kinetic energy of the fragmented polysilicon falling into the bag. It protects the walls of the plastic bag against contact with the sharp-edged polycrystalline silicon and prevents piercing of the plastic bag. Owing to the fact that the plastic bag is pulled downward after the filling, no sticking of the polycrystalline silicon in the energy absorber takes place.

Preferably, the polysilicon is first portioned and weighed before the packaging.

The filling unit is configured so that very fine particles and splinters of the polysilicon are removed before or during the filling. For example, particles with an edge length of less than 16 mm may be screened off reliably.

To this end, a product flow of polysilicon chunks is preferably transported via a feed chute, separated into coarse and fine chunks by means of at least one screen, in which case the screen may be a perforated plate, a grille screen, an optopneumatic sorter or another suitable device, weighed and dosed to a target weight by means of a dosing balance, discharged via a delivery chute and transported to a packaging unit.

Preferably, the at least one screen and the dosing balance at least partially comprise a low-contamination material, for example a hard metal, on their surfaces.

The portioning and weighing-in of the fragmented polysilicon are preferably carried out by means of a dosing unit for a device for dosing and packaging silicon chunks, comprising a feed chute suitable for conveying a product flow of chunks, at least one screen suitable for separating the product flow into coarse and fine chunks, a coarse dosing chute for coarse chunks and a fine dosing chute for fine chunks, and a dosing balance for determining the dosing weight, the at least one screen and the dosing balance at least partially comprising a hard metal on their surfaces.

Such a dosing unit is used to dose polysilicon chunks of a particular size class as accurately as possible before the packaging.

More accurate dosing of the polysilicon is possible by separating the product flow into coarse and fine parts.

The weighed-out amount of polysilicon chunks is packaged into a sheet bag according to the method described above after the dosing and an optional cleaning step.

The dosing unit comprises at least one screen, for example a grille screen, suitable for separating the chunks of the initial product flow into a coarse dosing chute and a fine dosing chute.

The dosing unit preferably comprises two screens, particularly preferably grille screens.

Coarse, or larger, polysilicon chunks are transported in a coarse dosing chute.

Fine, or smaller, polysilicon chunks are transported in a fine dosing chute.

The size distribution of the polysilicon chunks in the output product flow depends, inter alia, on the preceding comminution processes. The manner of separation into coarse and fine chunks, as well as the size of the coarse and fine chunks, depend on the desired end product which is to be dosed and packaged.

A typical fragment size distribution comprises chunks with a size of 5-170 mm.

For example, chunks below a particular size may be discharged from the dosing unit by means of a screen, preferably by means of a grille screen, in conjunction with a discharge chute. In this way, it is possible to dose only chunks of a very specific size class.

Undesired product sizes are again formed by the transport of the polysilicon on the feed chutes. These may, for example, be removed by separation in the dosing balance. To this end, the weighing balance is equipped with an opening, a changeable separation mechanism and a discharge unit.

In downstream processes, the discharged smaller chunks are reclassified, dosed and packaged or sent for a different use.

The dosing unit preferably comprises a fine component slide. This may be configured so that it can be swiveled into place. Depending on the desired target product (fragment size distribution), it will be used in order to screen out fine components and separate them from the product flow for the fine dosing.

The dosing of the polysilicon by means of the two dosing chutes may be automated.

It is particularly advantageous to use hard metal elements for the screen and dosing balance. At least the screen and dosing balance should at least partially comprise hard metal on their surfaces.

Hard metals are intended to mean sintered carbide hard metals. Besides the conventional hard metals based on tungsten carbide, there are also hard metals which preferably contain titanium carbide and titanium nitride as hard materials, in which case the binder phase comprises nickel, cobalt and molybdenum. Their use is also preferred in the context of the method according to the invention.

Preferably, at least the mechanically stressed, wear-sensitive surface regions of the screen and dosing balance comprise hard metal or ceramic/carbides. At least one screen is preferably made entirely of hard metal.

The screen and dosing balance may be provided partially or surface-wide with a coating. A material selected from the group consisting of titanium nitride, titanium carbide, aluminum titanium nitride and DLC (diamond-like carbon) is preferably used as the coating.

It has been found that the use of hard metal elements improves the mechanical stability of the dosing unit. Furthermore, the maintenance intervals of the dosing unit are much greater, since the hard metal elements wear less than the silicon and plastic claddings used in the prior art.

Surprisingly, it has been found that the contamination of silicon by using hard metal is not significantly increased compared with the use of silicon or plastic claddings. This relates in particular to the contamination with tungsten and cobalt.

By means of a controlled swiveling chute, the dosing unit furthermore makes it possible to distribute the silicon product flow between a plurality of dosing and packaging systems and therefore a combination of a plurality of dosing systems, which are filled with a starting product and, after dosing and weighing, transported to different packaging machines.

The dosing system contains separation mechanisms (screens), which screen off undesired smaller product sizes and then deliver these to the upstream processes (screening, classification).

The polysilicon chunks are preferably packaged in two plastic bags.

The packaging in a first plastic bag is carried out as mentioned above by using an energy absorber or a storage container.

The first plastic bag is subsequently sealed.

Preferably, the sealed bag is transferred by means of a gripper system or a conveyor belt to a machine part for applying a second bag.

As an alternative, two bags, one placed inside the other, may be filled with the polysilicon.

After the inner bag is welded, it slides to the bottom of the outer bag and the latter can likewise be welded.

According to another embodiment, the inner bag is placed fully inside the outer bag, the inner bag is welded and folded down, and the outer bag is welded after optional inspection.

What is claimed is:

1. A method for packaging polycrystalline silicon, said method comprising:

providing a filling device comprising a freely suspended energy absorber comprising a nonmetallic low-contamination material;

placing a plastic bag over the energy absorber;

filling the plastic bag with polycrystalline silicon by use of the filling device; and lowering the plastic bag downward during the filling, so that the polycrystalline silicon slides into the plastic bag;

wherein a cross-section of the plastic bag is reduced by use of a suitable device before the start of its lowering movement, and is increased gradually during the filling or after the filling, in order to achieve controlled filling of the plastic bag with polycrystalline silicon chunks.

2. The method according to one of claim 1, wherein the plastic bag comprises polyethylene (PE), polyethylene terephthalate (PET), polypropylene (PP) or composite sheet.

3. The method according to claim 1, wherein the energy absorber has a shape of a funnel, a tube or a hollow body.

4. The method according to claim 1, wherein the energy absorber comprises a weighing balance.

5. The method according to claim 1, wherein the energy absorber comprises a weighing balance which is configured as a screen and is located at a bottom of the energy absorber.

6. The method according to claim 1, wherein a mechanism is provided which produces a wave-like or shaking movement of the energy absorber during the filling, in order to be able to fully prevent sticking and achieve better separation.

* * * * *